US005135416A

United States Patent [19]

Hass et al.

[11] Patent Number: 5,135,416

[45] Date of Patent: Aug. 4, 1992

[54] ELECTRICAL CONNECTOR HOUSING

[75] Inventors: Jurgen Hass, Erzhausen; Gheorghe Hotea, Griesheim, both of Fed. Rep. of Germany

[73] Assignee: AMP Incorporated, Harrisburg, Pa.

[21] Appl. No.: 773,732

[22] Filed: Oct. 7, 1991

Related U.S. Application Data

[63] Continuation of Ser. No. 577,424, Sep. 4, 1990, abandoned.

[30] Foreign Application Priority Data

Sep. 6, 1989 [GB] United Kingdom ..... 8920154

[51] Int. Cl.[5] ..... H01R 13/436

[52] U.S. Cl. ..... 439/752; 439/595

[58] Field of Search ..... 439/595, 752

[56] References Cited

U.S. PATENT DOCUMENTS

| | | | |
|---|---|---|---|
| 3,573,720 | 4/1971 | Reynolds | 339/217 |
| 4,698,030 | 10/1987 | Ryll | 439/752 |
| 4,936,798 | 6/1990 | Hass et al. | 439/752 |

FOREIGN PATENT DOCUMENTS

| | | | |
|---|---|---|---|
| 8508465 | 2/1986 | Fed. Rep. of Germany | 13/436 |
| 607363 | 12/1978 | Switzerland | 13/42 |

OTHER PUBLICATIONS

EPO Search Report dated Jan. 14, 1991, Application No. 90117195.9.

*Primary Examiner*—Eugene F. Desmond

*Attorney, Agent, or Firm*—Eric J. Groen; Bruce J. Wolstoncroft

[57] ABSTRACT

An electrical connector insulating housing (2) defines a single ring of cavities (8) each for receiving an electrical terminal (28). A central spigot (78) projects within the ring of cavities (8), as a cantilever, and acts as a pivot for annular terminal retainer (4) having thereon radially outwardly projecting terminal retaining studs (114) and a pair of diametrically opposed latching spurs (120), each spur (120) being engageable in first and second latching notches (108 and 108') in the spigot (78). Guides are provided to ensure that the terminal retainer (4) can be mated with the spigot (78) only in a first angular position in which each latching spur (120) engages in a first latching notch (108), in which position the terminal retaining studs (114) are outside the cavities (8). A terminal (28) is then inserted to each cavity (8) and a tool is applied to the terminal retainer (4) by way of a mating face (120) of the housing (2), to rotate the terminal retainer (4) to a second angular position in which each spur (12) engages in a respective second latching notch (108') and in which position each terminal retaining member (114) overlies an abutment collar (44) on the terminal (28), to prevent it from backing out from its cavity (8) even under the action of severe vibration.

10 Claims, 14 Drawing Sheets

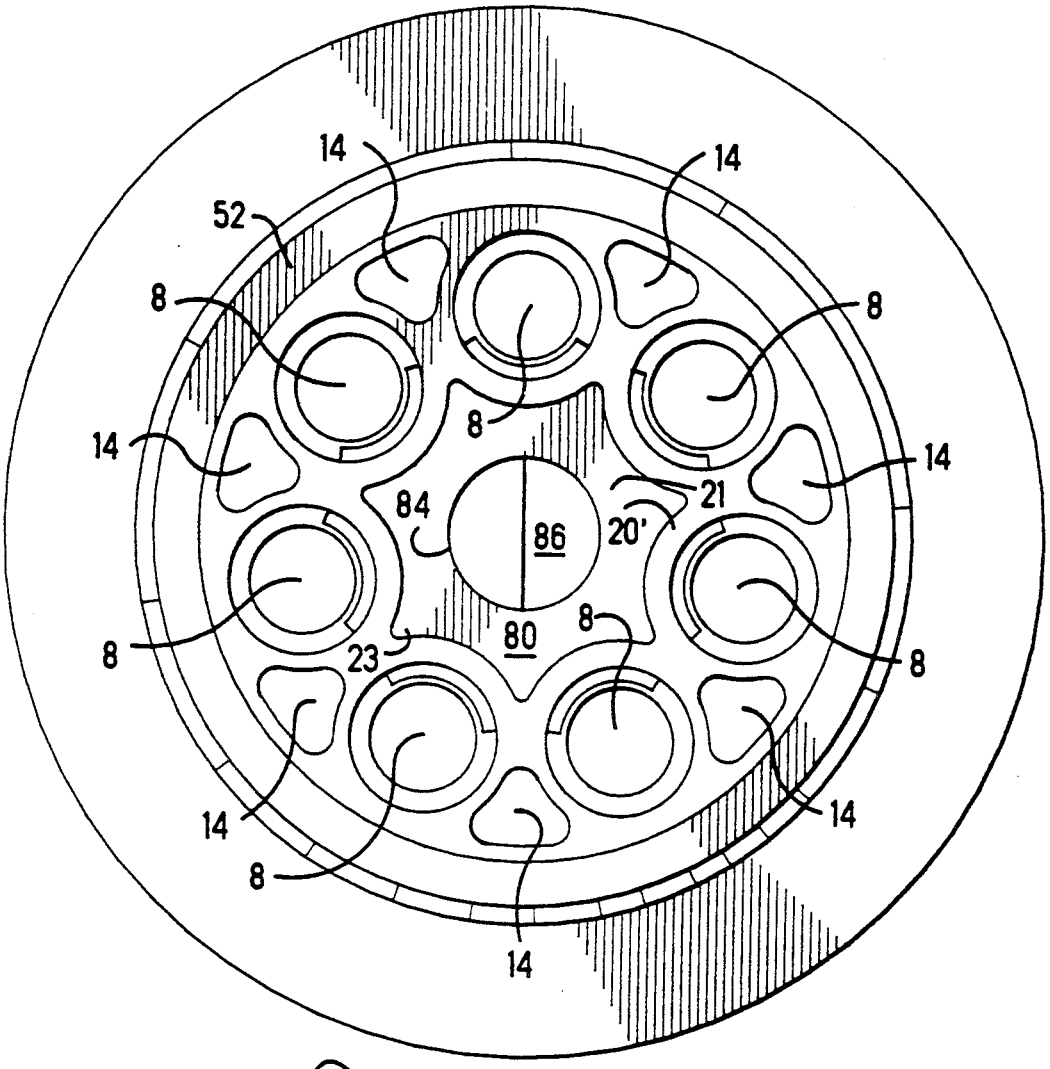
14
14
52
8
8
8
14
14
84
86
21
20'
8
80
8
23
8
14
14
8
14
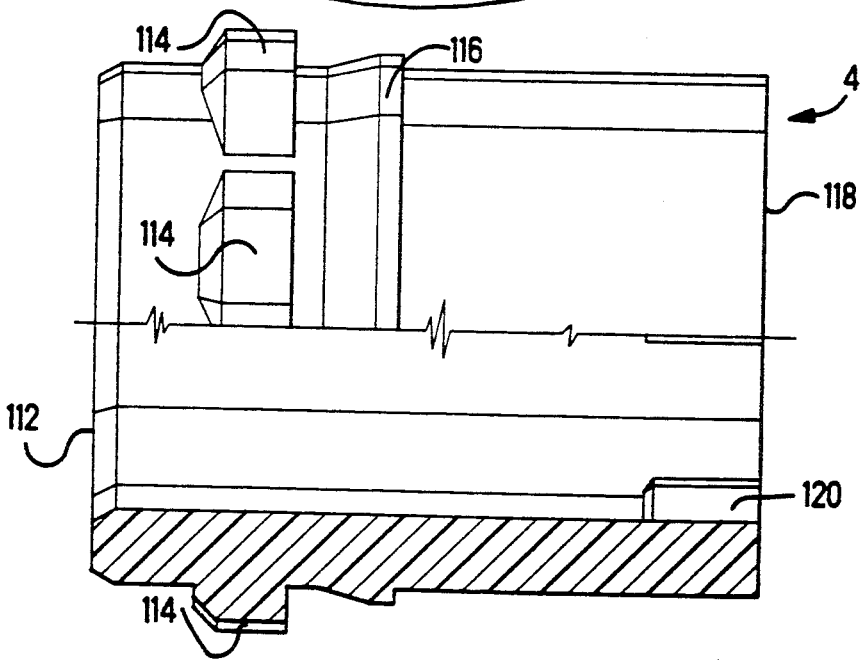
114
116
4
118
114
112
120
114

ELECTRICAL CONNECTOR HOUSING

This application is a continuation of application Ser. No. 07/577,424, filed Sept. 4, 1990, now abandoned.

This invention relates to an electrical connector insulating housing provided with means for locking electrical terminals in the housing.

There is disclosed in DE-U-8508465.4 an electrical connector insulating housing defining a series of spaced, elongate, terminal receiving cavities surrounding an axis of the housing and extending lengthwise of said axis, the housing receiving a terminal retainer for angular displacement about said axis between a first angular position to allow electrical terminals to be inserted into the cavities and a second angular position to overlie abutments on the terminals when they have been inserted into the cavities to lock the terminals therein.

In this known housing, the terminal retainer is received in a hood projecting from the housing, and is in the form of a circular cross-section block which presents a terminal receiving face of the housing. Since the terminal retainer must be angularly displaceable in the hood and cannot, therefore, be sealed thereto effectively, it is impracticable to seal the connector against the ingress of moisture by means of sealing grommets in the cavities. Although it has been proposed to avoid this disadvantage, by making the terminal retainer annular, and arranging it in surrounding relationship with the housing, in this case, because of the presence of the annular terminal retainer, the external periphery of the housing cannot be provided with keying means for cooperation with keying means on a mating electrical connector or indeed with any other means, for example a sealing ring, or means for securing the housing to a mating housing.

According to the present invention, a housing as defined in the second paragraph of this specification, is characterized in that the cavities are arranged in a single ring about said axis and the terminal retainer, which is annular, is mounted for said angular displacement on a spigot which projects as a cantilever within said ring of cavities from a housing wall extending transversely of the cavities; and in that the terminal retainer has radially outwardly directed terminal retaining members which intersect the cavities in the second angular position of the terminal retainer to overlie said abutments.

Since the terminal retainer is disposed within the single ring of terminal receiving cavities, the outer periphery of the housing is free to receive a sealing ring for the provision of keying or securing means thereon.

For economy of the housing material, the said transverse wall may be positioned substantially longitudinally centrally of the cavities.

According to embodiments of the invention, the terminal retainer is insertable into an annular recess defined by the housing, between the spigot and radially inner walls of the cavities, with the aid of guide means provided on the terminal retainer and cooperating with complementary guide means on the spigot or between the cavities, to locate the terminal retainer, in its first angular position, the terminal retainer having latching means cooperating with shoulders presented by said inner walls to latch the terminal retainer in its recess.

According to a first embodiment of the invention, in which the cavities may, for example, be seven in number, the spigot has at least one latch arm formed with first and second external, circumferentially spaced latching notches and the terminal retainer has at least one inwardly directed latching spur for latching engagement with the first notch in the first position of the terminal retainer and in the second notch in the second position thereof. The resilience of the latch arm, ensures that as the terminal retainer is rotated between its first and second angular positions, the latch arm is resiliently depressed, to allow the latching spur to pass from the first to the second notch with a snap action.

The spigot may, according to this embodiment, be formed with a longitudinally indented keying surface proximate to said transverse wall and extending in the direction of the free end of the spigot, the terminal retainer having a radially inwardly projecting resilient keying pad shaped complementarily with said keying surface. These keying means ensure that the terminal retainer is insertable into its recess, only in the first angular position of the terminal retainer, the resilience of the keying pad, nevertheless allowing the terminal retainer to be shifted from its first to its second angular position against the resilient action of the keying pad. Resilience may be imparted to the keying pad, which extends longitudinally of the terminal retainer, by forming it with an internal opening substantially throughout its length.

The spigot may comprise an annular wall concentric with the axis of the housing and which extends from the transverse wall mentioned above, towards a mating face of the housing, a solid part extending from the annular wall towards the mating face, and, extending from the solid part up to the mating face, a longitudinally divided part providing said latch arm or latch the spigot and upon radially the outer surface of said annular wall.

According to a second embodiment of the invention, the spigot is formed as a simple tube of constant circular cross-section, the terminal retainer, having a circular cross-section bore for receiving the spigot, and having a pair of diametrically opposed latching spurs projecting radially outwardly thereof. The housing is formed, between the cavities which according to this embodiment, are few, being, for example, only four in number, with first and second circumferentially spaced latching notches each for receiving a latching tip of a respective latching spur in the first and second angular positions, respectively, of the terminal retainer. In order to ensure that the terminal retainer can be mated with the spigot only in its first angular position, it may be provided with guide ribs extending longitudinally thereof and cooperating with guide surfaces between the cavities, to that end. The terminal retaining members are, according to the second embodiment, positioned proximate to the leading end of the terminal retainer. The guide ribs, which are of substantially equal height to the terminal retaining members, but which are of considerably smaller width circumferentially, extend from the terminal retainer members towards the latching spurs.

The latching notches extend radially outwardly from wells formed in the housing, between the cavities thereof, and opening into a mating face of the housing by way of which the terminal retainer is accessible so as to be movable between its first and second angular positions, for example by means of a tool blade inserted into a slot in the terminal retainer. Each well communicates in the circumferential direction of the housing, with a respective terminal receiving cavity and according to the second embodiment, is provided with arcuate side walls for cooperation with complementarily shaped surfaces for the guide ribs.

For a better understanding of the invention and to show how it may be carried into effect, two embodiments thereof will now be described by way of example with reference to the accompanying drawings in which:

FIG. 4 is a fragmentary rear end view of the housing shown in FIG. 1;

FIG. 5 is a side view shown partly in axial section of the terminal retainer;

The first embodiment of the invention will now be described with reference to FIGS. 1 to 12. An electrical connector housing 2, of circular cross-section, comprises for assembly thereto, a terminal retainer 4, (FIGS. 5 to 9) and a coupling ring 6 (shown in FIGS. 10 and 11) for securing the housing 2 to a mating electrical connector housing (not shown).

Figure 1:
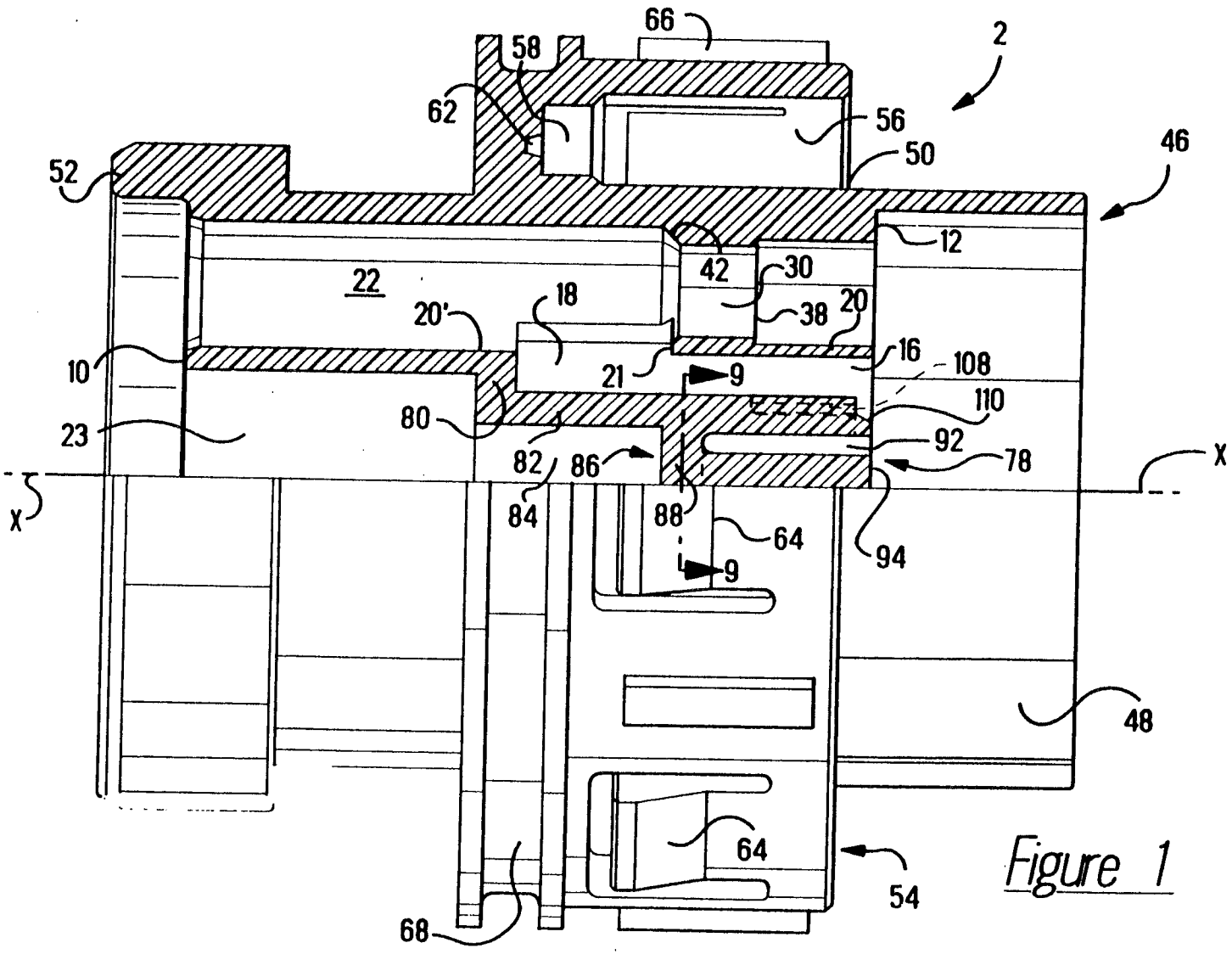
FIG. 1 is an enlarged side view shown partly in axial section, of an electrical connector housing for receiving a terminal retainer, according to a first embodiment of the invention.
Figure 3:
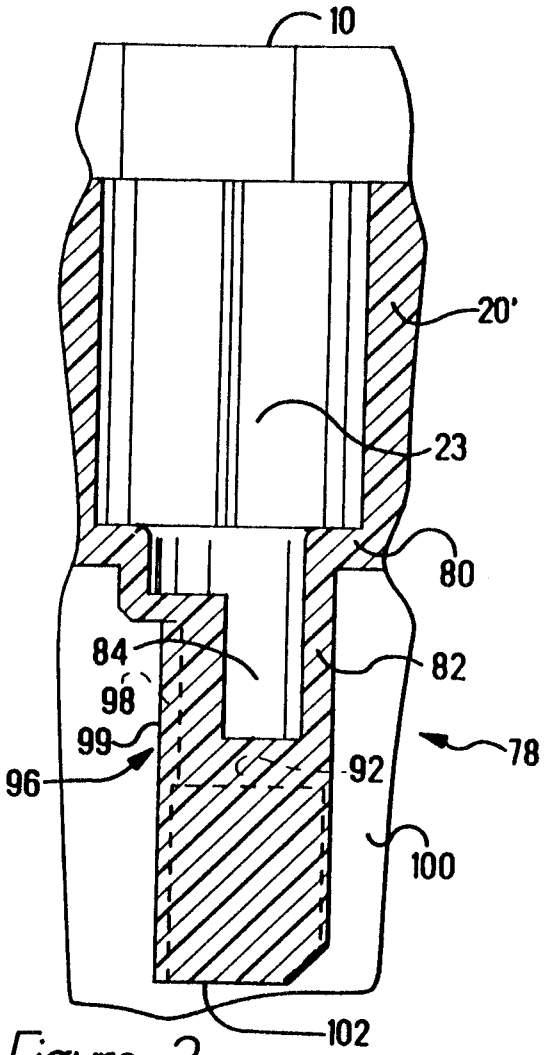
FIG. 3 is a fragmentary sectional view taken on the lines 3—3 of FIG. 2.
Figure 2:
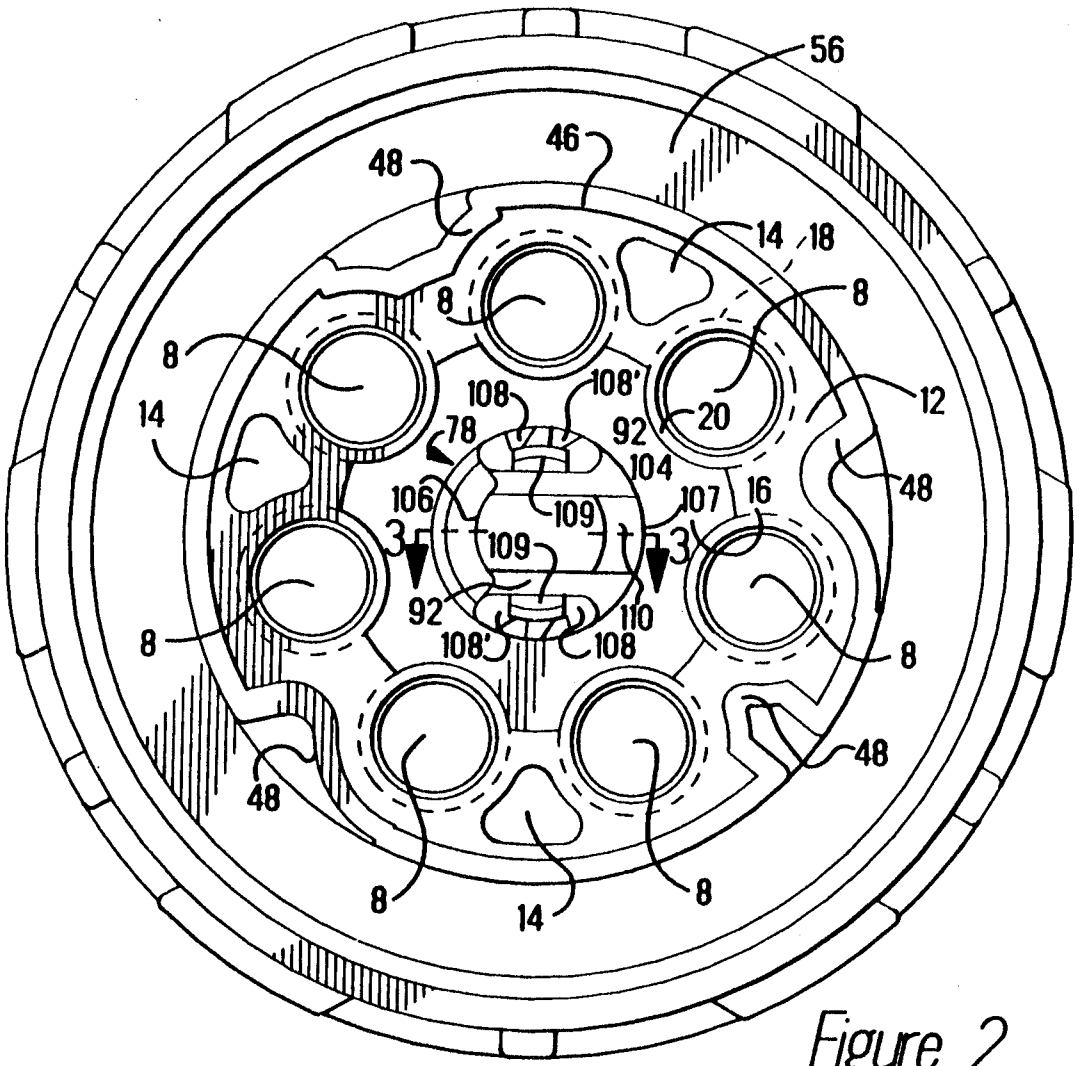
FIG. 2 is a fragmentary front end view of the housing shown in FIG. 1.
Figure 10:
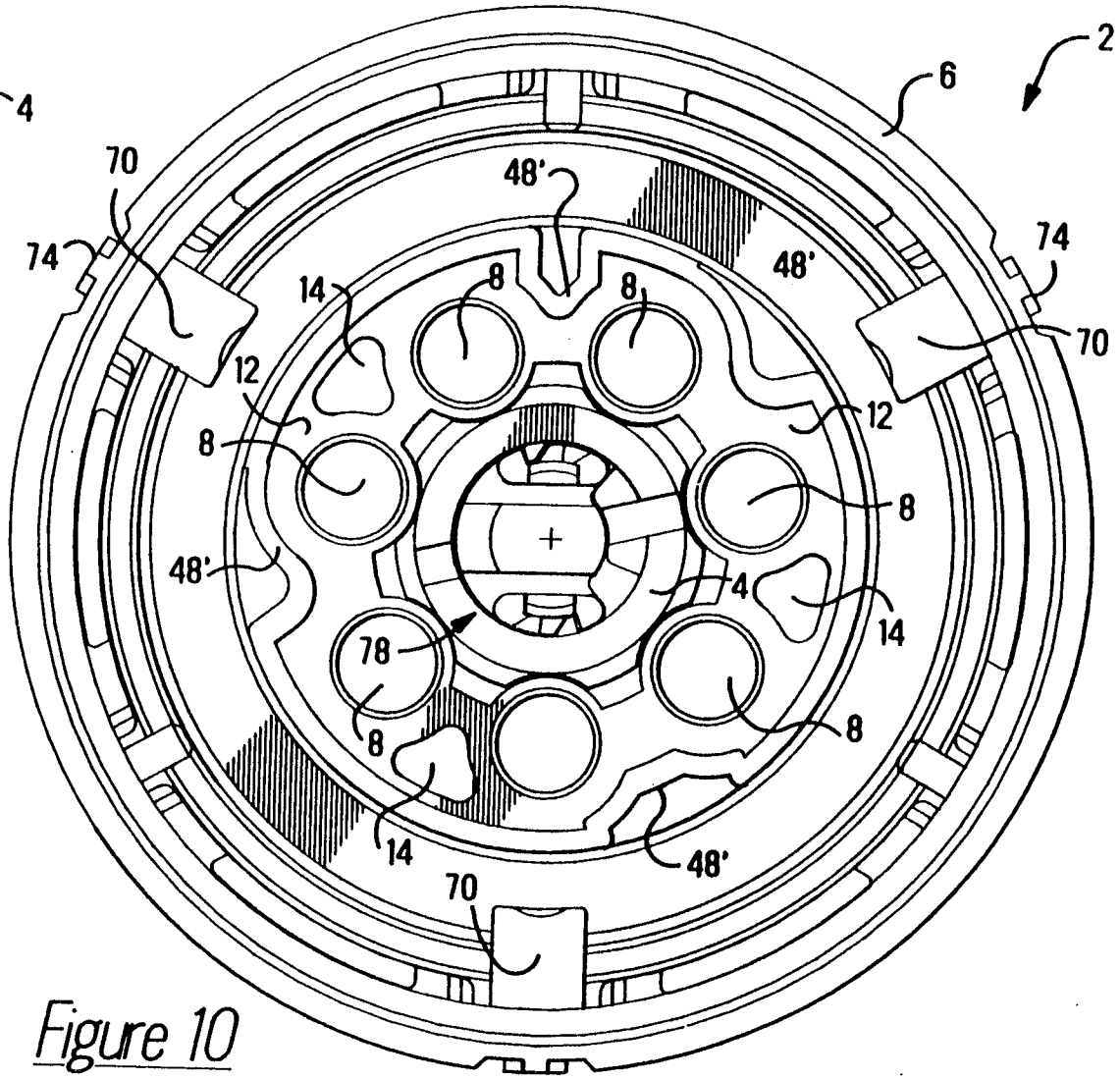
FIG. 10 is a front end view of the housing drawn to a smaller scale than FIGS. 1 to 9, illustrating a modification and showing the terminal retainer and a coupling ring assembled to the housing, the terminal retainer being shown in a terminal insertion angular position about the spigot.

As shown in FIGS. 2, 4 and 10, the housing 2 defines a single ring of seven spaced, terminal receiving, circular cross-section through cavities 8, concentric with the longitudinal axis X—X (FIGS. 1 and 11) of the housing 2, each cavity 8 opening into a terminal, receiving rear face 10 of the housing 2 and into a mating, front face 12 thereof. Between the cavities 8, blind holes 14 were formed in the faces 10 and 12 during the molding of the housing 2, from a suitable insulating material, to provide relief for warpage of the material as it cooled after the molding operation.

As best seen in FIGS. 1 and 2, the housing 2 defines an annular recess 16 concentric with the axis X—X and with the ring of cavities 8, for receiving the terminal retainer 4. The recess 16 opens forwardly into the mating face 12 and communicate rearwardly with annular opening 18 which in turn communicates with each of the cavities 8.

Figure 11:
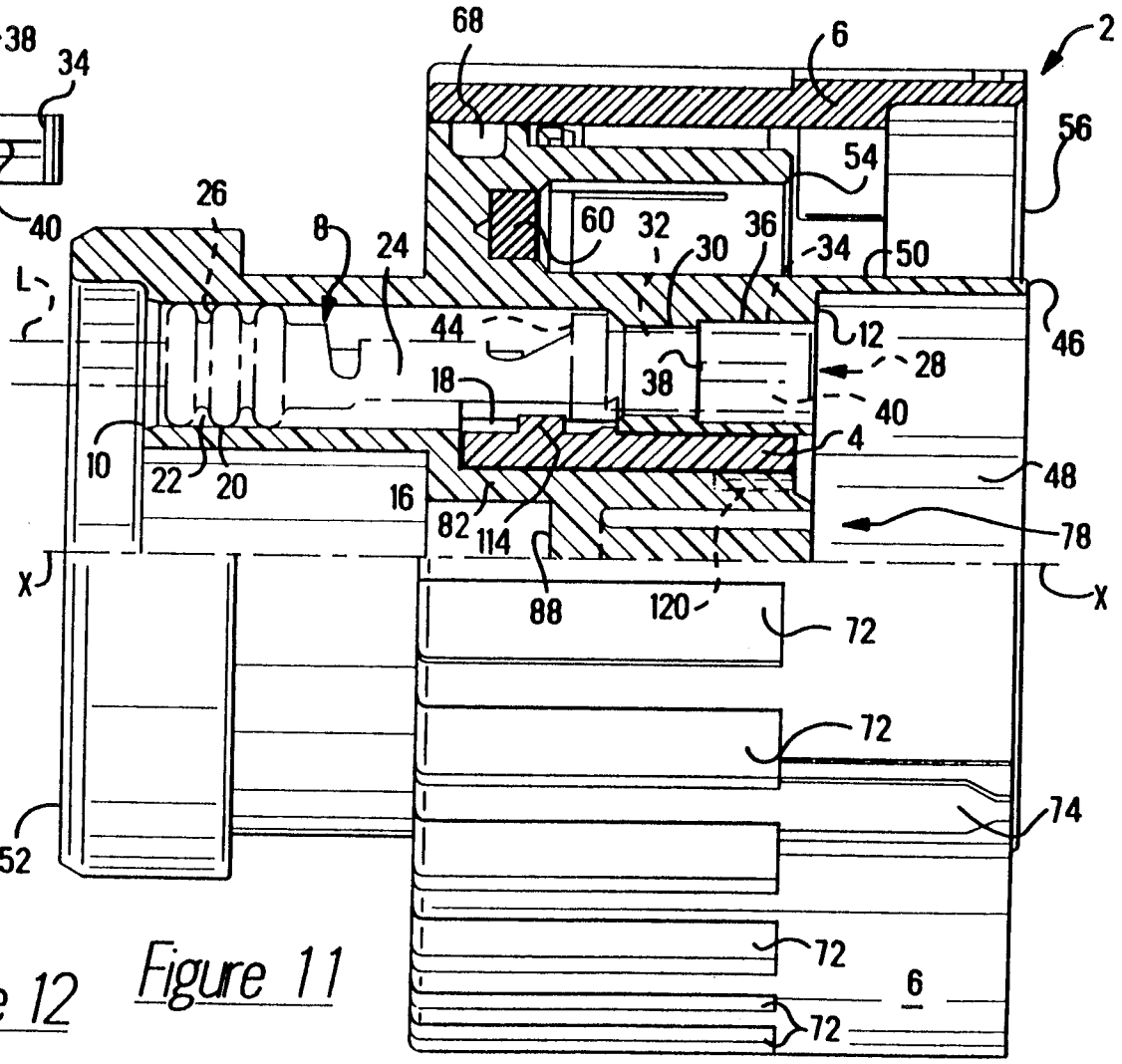
FIG. 11 is a side view of FIG. 10 shown partly in axial section and indicating in broken lines an electrical terminal inserted into a terminal receiving cavity of the housing, the terminal retainer being shown in a terminal locking angular position about the spigot.
Figure 11A:
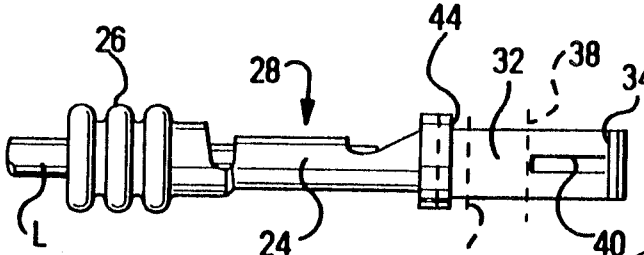
FIG. 11A is a side view of the electrical terminal.

Each cavity 8 is shaped and dimensioned to receive an electrical terminal 28 (FIGS. 11 and 11A). Each terminal 28 comprises a crimping ferrule 24 crimped to an insulated lead L and to a sealing grommet 26, a mounting portion 32, a circular abutment flange 44 between the ferrule 24 and the portion 32, and a mating portion 34 in the form of an electrical socket having a longitudinally extending latching tongue 40 struck out therefrom. Each cavity 8 has a large cross section part 22 for receiving the ferrule 24 and grommet 26, a smaller cross section part 30 for receiving the mounting portion 32, intermediate the cavity part 22 and a larger cross section part 36 for receiving the mating portion 34 of the terminal 28. There is defined between the parts 22 and 30 of each cavity 8, an annular shoulder 42 for abutment by the flange 44 of the terminal 28, and between the parts 30 and 36 an annular shoulder 38 for engagement by the free, rearward end of the latching tongue 40 of the terminal 28. When terminals 28 are assembled in the housing 2, the free ends of the mating portions 34 of the terminals 28 are substantially flush with the mating face 12 of the housing 2, the leads L projecting from the terminal receiving face 10.

The radially inner wall 20 of the parts 30 and 36 of each cavity 8 defines an annular latching shoulder 21, projecting slightly into the recess 16 The radially inner wall 20' of the part 22 defining star shaped cavity 23.

There projects from the mating face 12, a hood 46 formed with external keyways 48 each dimensioned to receive a respective key (not shown) in a hood of the said mating housing. The keyways 48 also extend inwardly, over part of an outer peripheral wall 50 of the housing 2. The keyways 48 will differ in configuration and arrangement from one housing 2 to another, as illustrated by way of example by the keyways 48' in FIG. 10. There projects from the terminal receiving face 10 of the housing 2 a skirt 52 and there extends radially outwardly from the wall 50, a latching ring 54, defining in cooperation therewith an annular socket 56 having a forward reduced cross section part 58 for receiving, as shown in FIG. 11, a sealing ring 60, the part 58 communicating with a frusto-conical rear annular recess 62 into which the ring 60 is extruded when the housing 2 has been mated with said mating housing. The latching ring 54 is formed with resilient latch arms 64 distributed about its external periphery and having free ends which are rearwardly directed. Between each pair of adjacent arms 64, is an axial rib 66, the ring 54 being formed rearwardly of the free ends of the arms 64, with a peripheral groove 68. The coupling ring 6 has radially inwardly projecting studs 70 (FIG. 10) for meshing with a screw thread of said mating housing. When the coupling ring 6 has been assembled to the housing 2, the latch arms 64 are depressed by peripherally spaced internal ribs (not shown) on the coupling ring 6 which ribs resiliently depress the latch arms 64 and then engage in the groove 68, the latch arms 64 then resiling to latch the ring 6 to the ring 54. To aid in screwing the coupling ring 6 to the mating housing, the former is provided with finger grips 72 (FIG. 11) and with angular position indicators 74 for coincidence with complementary indicators on said mating housing to indicate when housings have been correctly secured together by means of the coupling ring 6.

A substantially circular overall cross section spigot 78 (best seen in FIGS. 1 to 3 and 9) providing a pivot for the terminal retainer 4 when mated with the spigot 78, projects forwardly into the recess 16 from an annular wall 80 projecting radially inwardly from the walls 20' and being positioned generally centrally of the length of the cavities 8. The spigot 78 comprises an annular rear wall portion 82 concentric with the axis X—X and defining a space 84 rearwardly of a body portion 86 of the spigot 78, the portion 86 extending forwardly from the wall 82 and comprising a solid rear part 88 and a longitudinally divided forward part 90 formed with two spaced longitudinal slots 92 running from the free forward end 94 of the body portion 86. The part 88 and the wall 82 are formed radially outwardly thereof and upon one side, with an undulating, (as best seen in cross section FIG. 9), keying surface 96 defining a pair of spaced, arcuately concave troughs 98 extending longitudinally of the spigot 78 and being separated by a convexly arcuate cusp 99. The slots 92 in the forward part 90 cooperate to define a central column 100, which terminates in a flat surface 102 at said forward end 94. The column 100 has parallel flat sides 104 and arcuately convex end walls 106 and 107, the latter terminating at the end 94 in a chamfered guide surface 110 and the former being aligned with the cusp 99. The slots 92 serve to define, opposite to each side 104, a resilient latch arm 109. Each arm 109 is formed with a pair of radially spaced, longitudinal latching notches 108 and 108' respectively.

Figure 6:
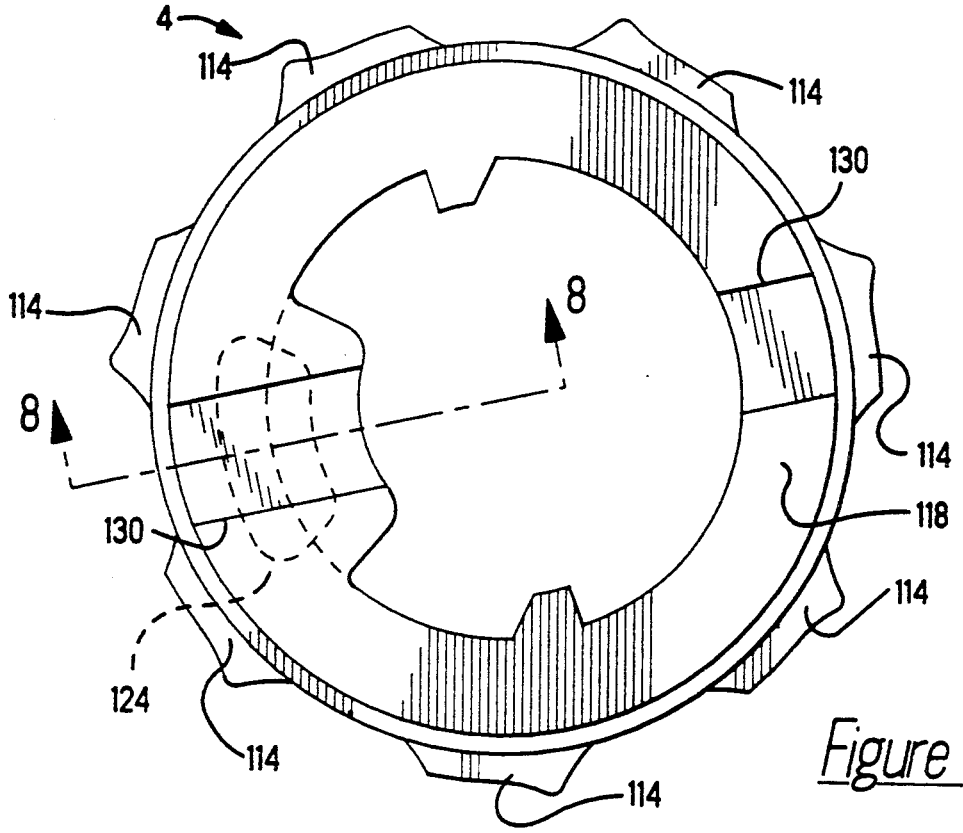
FIG. 6 is a front end view of the terminal retainer.
Figure 7:
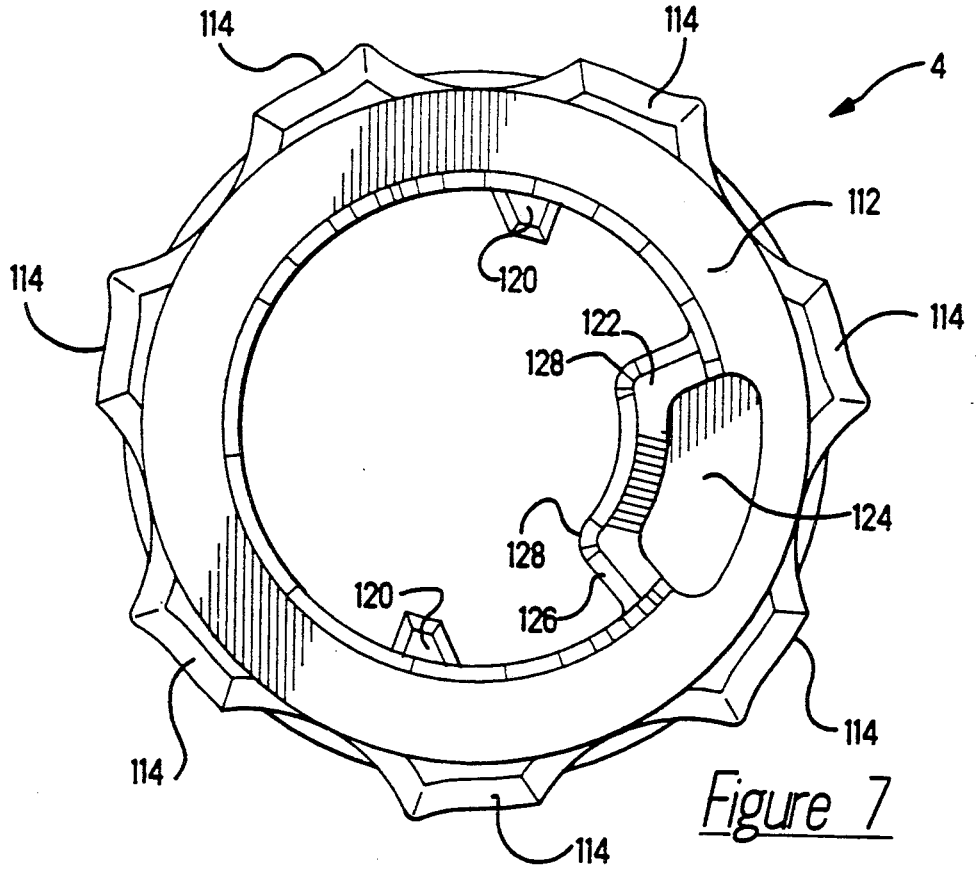
FIG. 7 is a rear end view of the terminal retainer.
Figure 9:
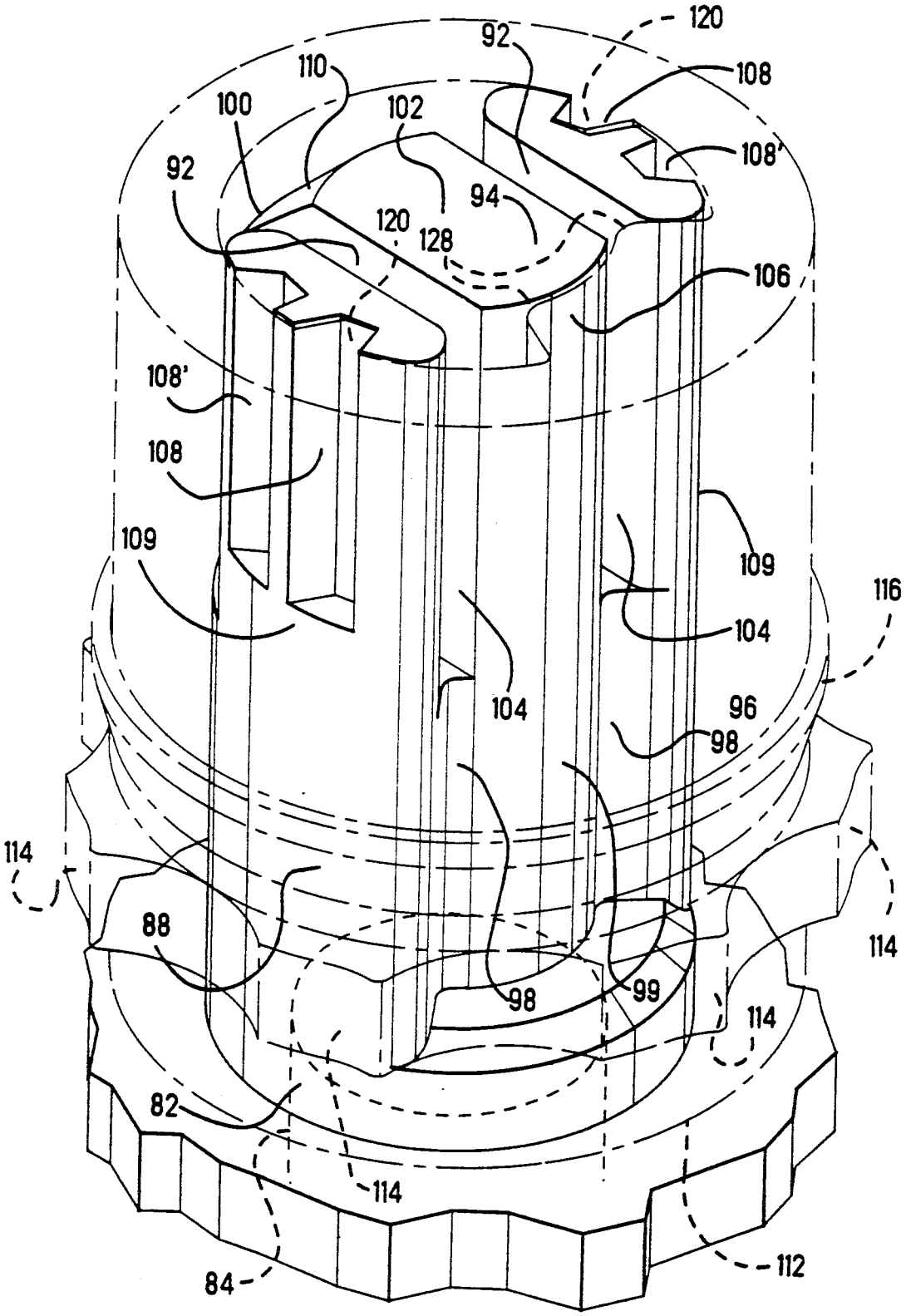
FIG. 9 is an enlarged isometric view of a central spigot of the housing of FIGS. 1 to 4, shown partly in section on the lines 9—9 of FIG. 1.
Figure 8:
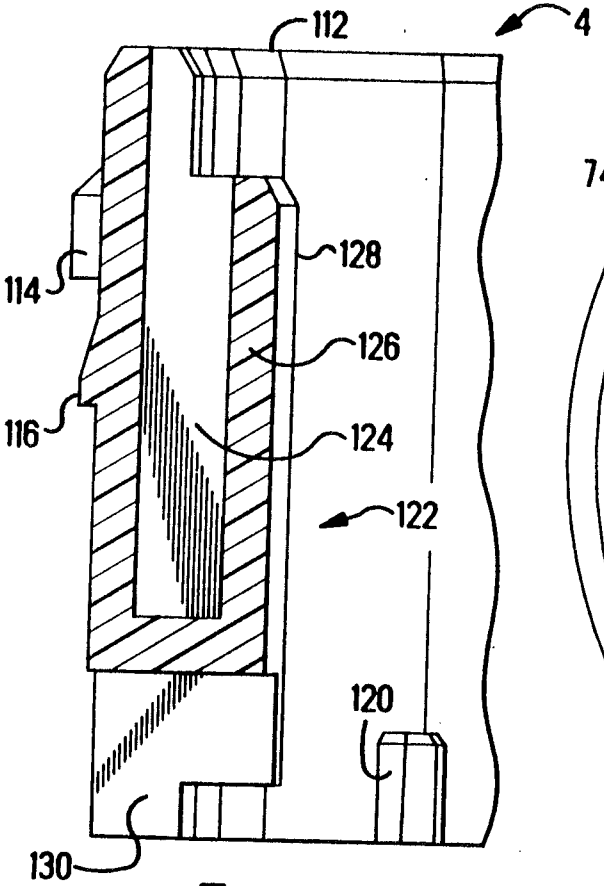
FIG. 8 is a fragmentary sectional view taken on the lines 8—8 of FIG. 6.

As best seen in FIGS. 5 to 8, the terminal retainer 4, which is in the form of an open ended tube of substantially circular cross section, is formed proximate to its leading end 112, (that is to say its end which leads when the retainer 4 is mated with the spigot 78), with a ring of seven terminal locking members in the form of studs 114, spaced constantly about its outer periphery with the same spacing as that between the cavities 8. The studs 114 taper in height in a clockwise (as seen in FIG. 6) sense. Outer periphery of the retainer 4 is also formed with a latching rib 116 extending continuously thereabout and tapering in height in the direction of the leading end 112. Proximate to its trailing end 118, the internal periphery of the retainer 4 is formed with two diametrically opposite latching spurs 120. A keying pad 122, which is resilient by virtue of an opening 124 therein which, as shown in FIG. 8, extends substantially throughout its length, projects internally of the retainer 4, and has a wall 126 facing inwardly thereof and being provided with a pair of spaced longitudinal ribs 128 each for engaging in a respective trough 98 of the part 88 in the wall 82 of the spigot 78. The pad 122 is positioned somewhat nearer to the end 122 than to the end 118 and is located angularly, midway between the two spurs 120. At its trailing end 118, the retainer 4 is formed with diametrically opposed slots 130 for receiving a tool blade (not shown) for rotating the terminal retainer 4 when it has been mated with the spigot 78, between terminal receiving, and terminal locking positions, as described below.

The terminal retainer 4 is assembled to the housing 2, that is to say it is mated with the spigot 78, by inserting the retainer 4 into the recess 16 from the mating face 12 of the housing 2 with the end 112 of the retainer 4 leading and the keying pad 122 aligned with the keying surface 96 of the spigot 78. As the retainer 4 enters the recess 16, the ribs 128 of the pad 122 engage in (as indicated in broken lines in FIG. 9) and pass along, the slots 92 of the spigot 78, until they engage in the troughs 98. During the advance of the retainer 4 into the recess 16, the latching rib 116, which is resiliently depressed by the wall 20 of the housing 2, finally snaps into engagement with shoulder 21 thereby securing the retainer 4 against backing out from the recess 16. In this fully mated position of the retainer 4, each spur 120 thereof engages the latching notch 108 of a respective latch arm 109. The terminal retainer 4 is then a terminal receiving angular position as shown in FIG. 10 and as shown in full lines in FIG. 12 and is held in that position by virtue of the resilient engagement of the ribs 128 of the pad 122 in the troughs 98 of the spigot 78. By virtue of the keying action on the surface 96 and the pad 122, the retainer 4 cannot be assembled to the housing 2 with the spurs 120 in the notches 108'.

Figure 12:
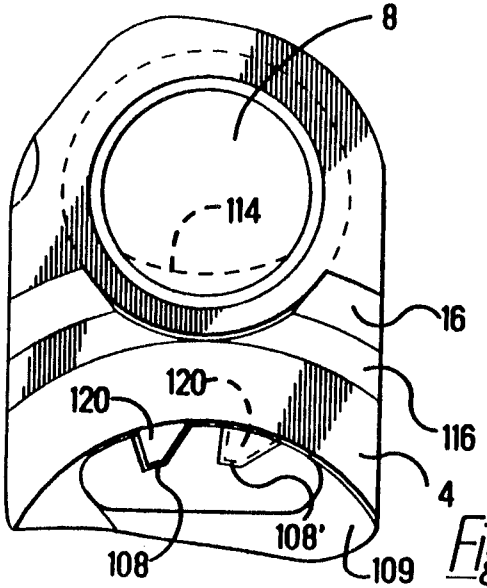
FIG. 12 is an enlarged fragmentary front view illustrating details of the housing as shown in FIG. 10, the terminal retainer being shown in its terminal locking position in broken lines.

Since the terminal locking studs 114 lie between the cavities 8 and so do not obstruct them, a terminal 28 can now be inserted into each cavity 8 from the terminal receiving face 10. As will be apparent from the above description relating to FIGS. 1, 11 and 11A, the terminals 28 are latched in their cavities by cooperation between their latching tongues 40 and the shoulders 38 in the cavities 8. In spite of this latching action, the terminals 28 could still back out from their cavities under the action of vibration, if the leads L are pulled, when the housing is in use, as the struck out tongues 40 will not normally be robust enough to prevent such terminal backout, since the metal stock from which the terminals were formed will usually be very thin. In order to prevent the terminals 28 from backing out from the cavities 8, under the circumstances outlined above, the tool blade is inserted into the slots 130 of the trailing end 118 of the retainer 4, which are accessible from the mating face 12, and the blade is rotated angularly to shift the terminal retainer 4 a few degrees in a clockwise (as seen in FIG. 10) sense, against the resilient action of the pad 122, to cause each spur 120 of the retainer 4 to snap into locking engagement with the adjacent notch 108' of the spigot 78, so that as shown in FIG. 12 in broken lines, and as shown in FIG. 11, each locking stud 114 of the retainer 4 is moved into the respective cavity 8 so as to overlie the abutment flange 44 of the terminal 28 therein so that the terminal can under no circumstances back out therefrom.

The second embodiment of the invention will now be described with reference to FIGS. 13 to 23, in which certain of the parts already described above with reference to FIGS. 1 to 12 bear same reference numerals thereas but with the addition of the index letter "a", in the interest of avoiding undue repetition in the description relating to FIGS. 13 to 23. An electrical connector housing 140 of substantially circular overall cross section, comprises for assembly thereto a terminal retainer 142, and a coupling ring 6a. The housing 140 defines a single ring of four spaced terminal receiving cavities 8a each opening into the terminal receiving rear face 10a of the housing 140 and into the mating front face 12a thereof. The cavities 8a are of the same configuration as the cavities 8, being dimensioned to receive the terminals 28 described above.

Figure 13:
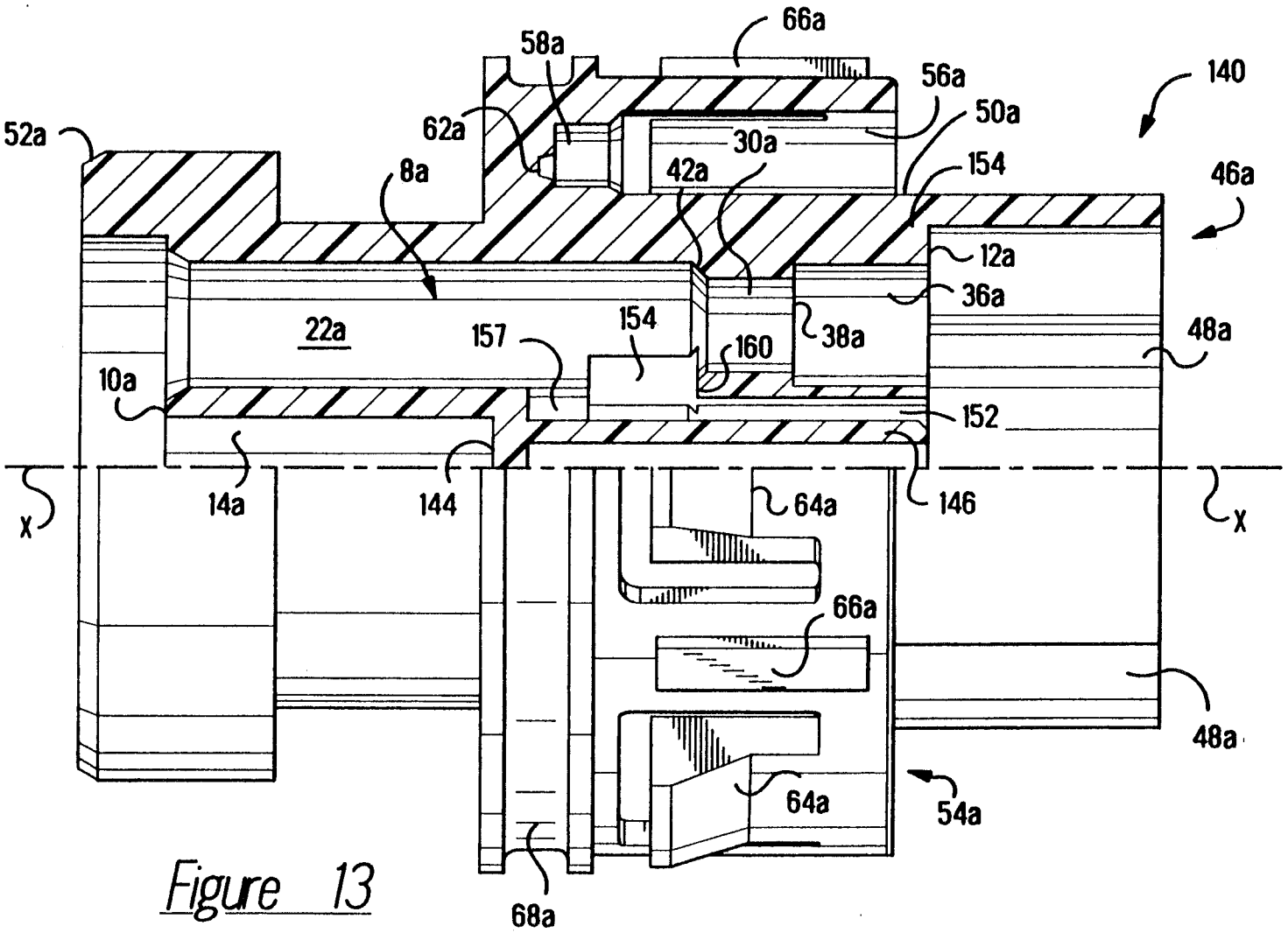
FIG. 13 is an enlarged side view shown partly in axial section, of an electrical connector housing for receiving a terminal retainer, according to a second embodiment of the invention.
Figure 15:
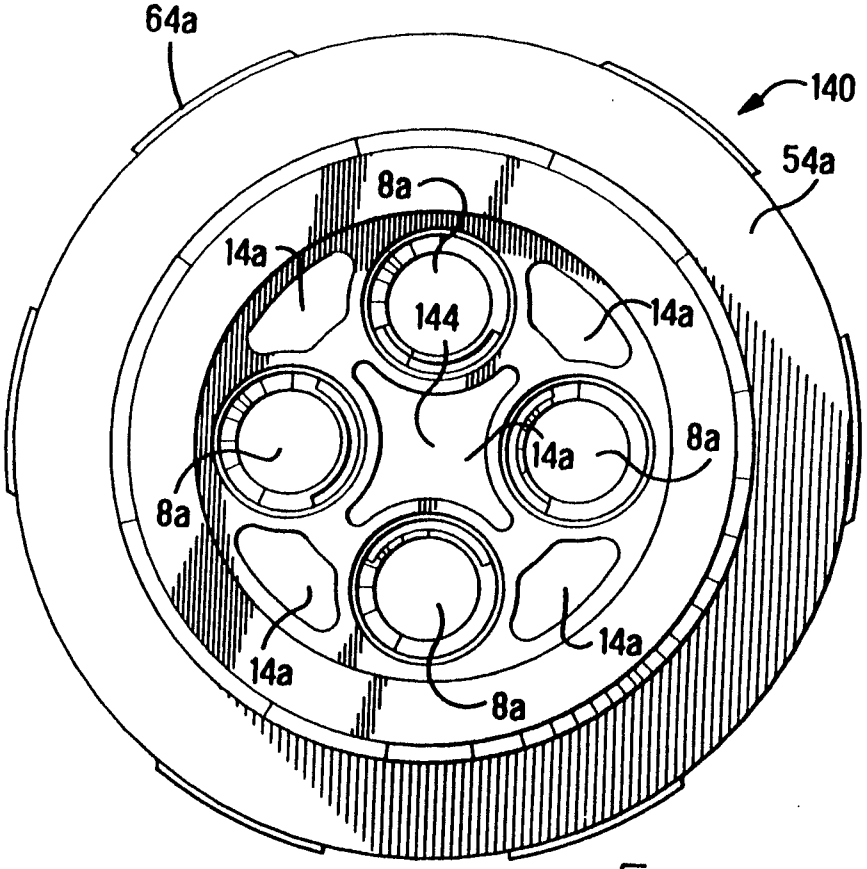
FIG. 15 is a rear view of the housing of FIGS. 13 and 14.
Figure 14:
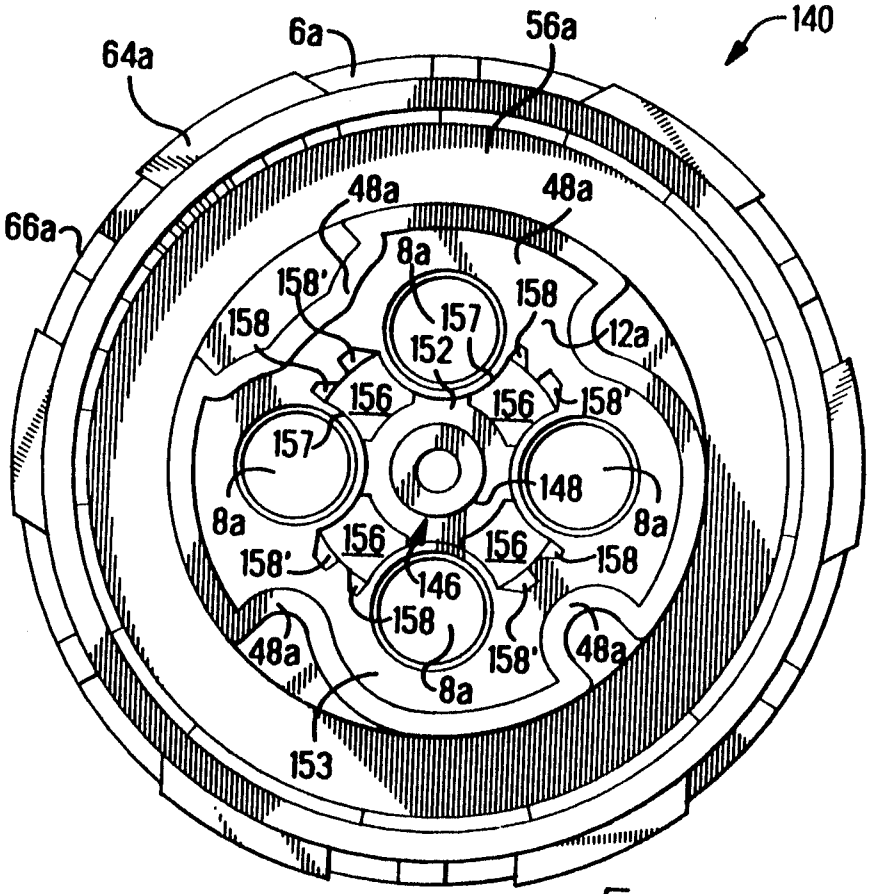
FIG. 14 is a front view of the housing of FIG. 13.
Figure 16:
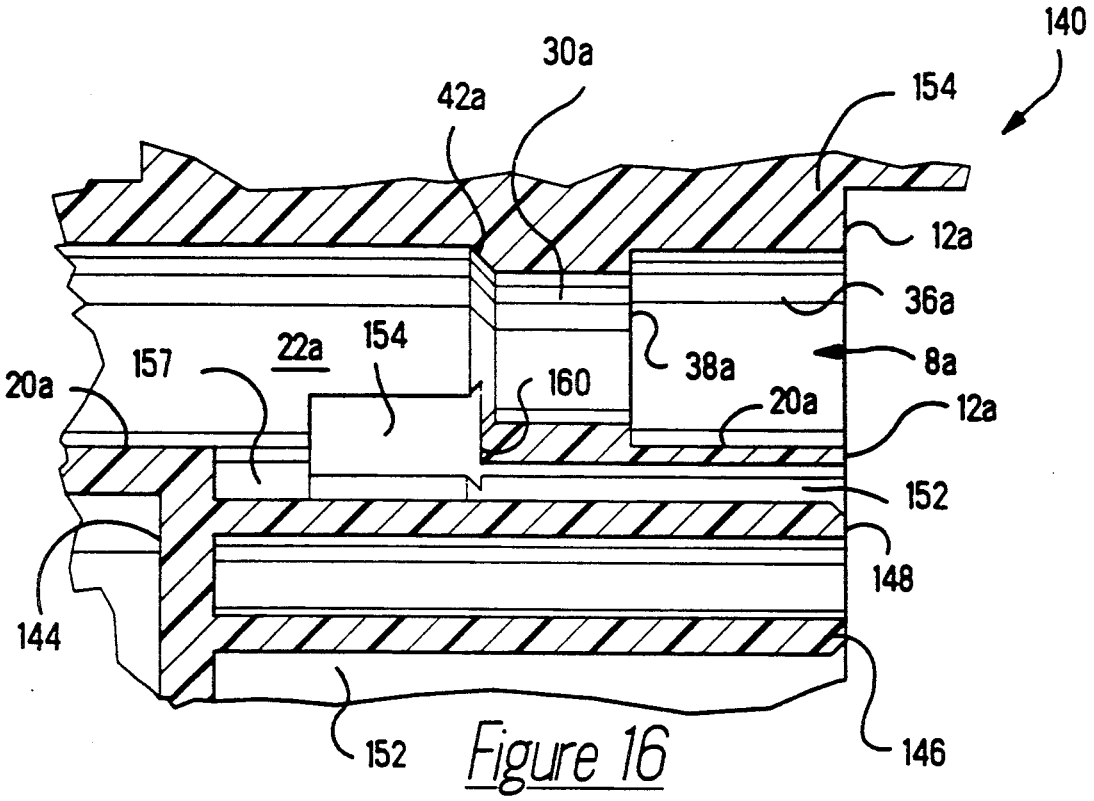
FIG. 16 is a fragmentary sectional view illustrating details of FIG. 13.
Figure 17:
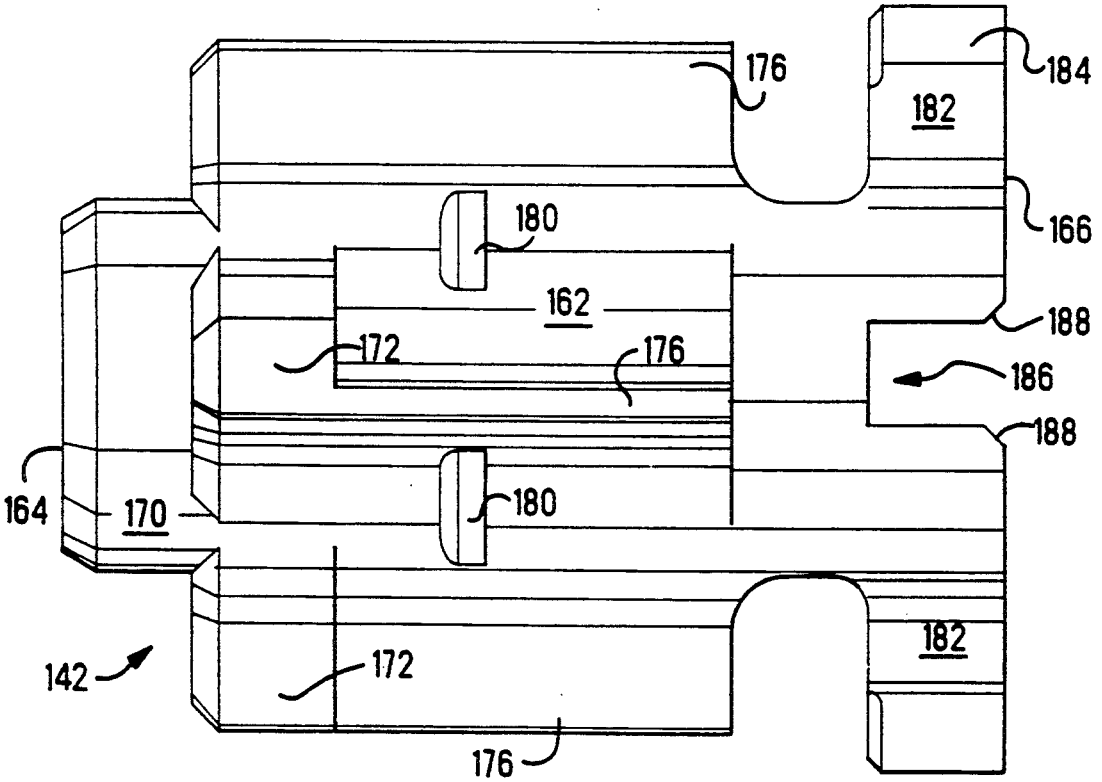
FIG. 17 is an enlarged side view of the terminal retainer for the housing of FIGS. 13 to 16.
Figure 19:
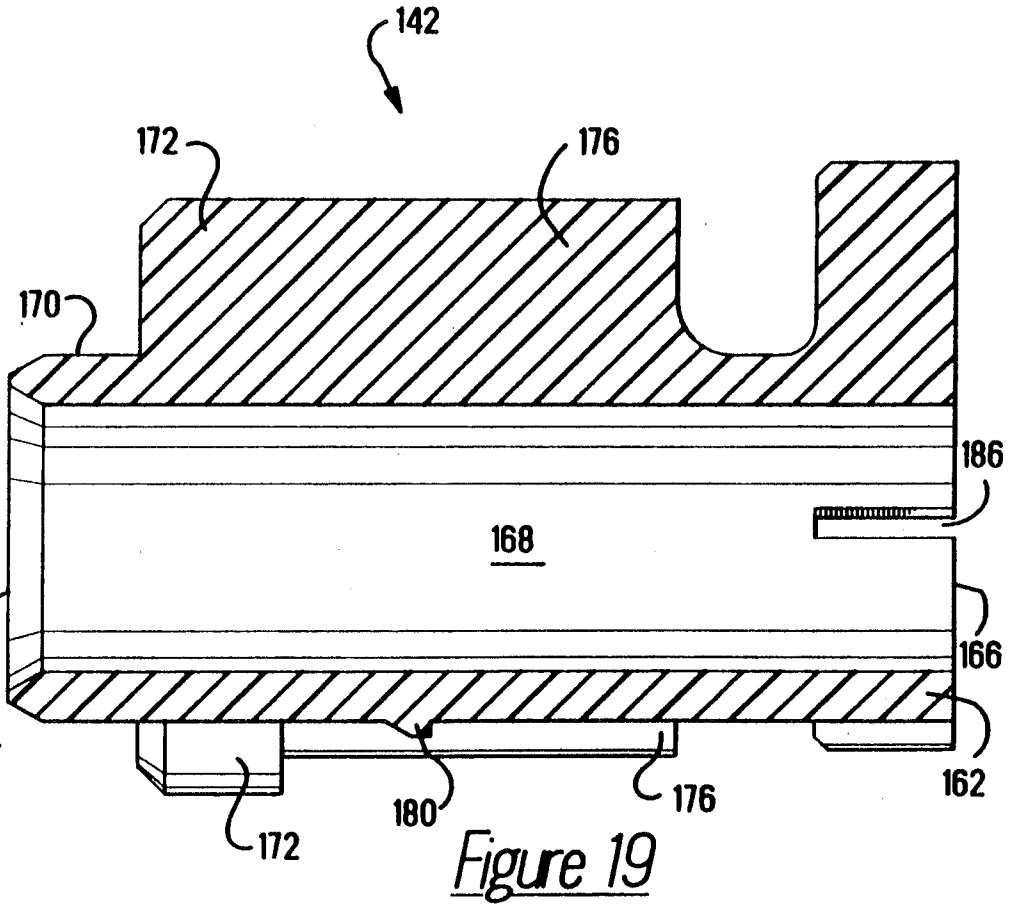
FIG. 19 is a view taken on the lines 19—19 of FIG. 18.

A wall 144 extending between the walls 20'a of the cavities 8a at right angles thereto and being positioned generally centrally their length, provides, as best seen in FIGS. 13 and 16, a base for a circular constant cross-section, tubular spigot 146 which projects forwardly from the wall 144 up to the mating face 12a of the housing 140 and has a free end 148 substantially flush with the face 12a as shown in FIG. 16. The spigot 146 cooperates with the body 153 of the housing 140 to define the annular recess 152 to allow the terminal retainer 142 to be mated with the spigot 146 so that the latter acts as a pivot for the retainer 142 as described below. The recess 152 opens radially outwardly, into four wells 156 which are constantly spaced about the axis X—X of the housing 140 and are defined by the body 153, each well 156 opening into the mating face 12a and being disposed between the cavities 8a of an adjacent pair of those cavities. The wells 156 also communicate with openings 154 in the body 153, each of which in turn communicates with the interior of the part 22a of a respective cavity 8a. Each opening 154 extends, in the longitudinal direction of the cavities 8a, from the shoulder 42a in the respective cavity portion 22a, to a position spaced forwardly from wall 144 by a short length 159 of the recess 152. The wells 156 have smoothly inwardly convex sidewalls 157, as best seen in FIG. 14. The radially outer end of each well 156 opens into a pair of circumferentially spaced latching notches 158 and 158' (best seen in FIGS. 14 and 23) at the forward end of the spigot 146 and which open into the mating face 12a. The notches 158 and 158a of each pair are located midway between two adjacent ones of the cavities 8a. At the forward end of each opening 154 in the wall of each cavity 8a the cavity wall 20a defines the latching shoulder 21a which can best be seen in FIGS. 1 and 16.

The terminal retainer 142 will now be described with a particular reference to FIGS. 17 to 20. The retainer 142 comprises a tubular body 162 having a leading end 164 and a trailing end 166 and defining a central through bore 168 dimensioned to receive the spigot 146. The end 164 is presented by a nose 170 which is chamfered theretowards but is otherwise of constant cross section. There project radially outwardly from the body 162 just behind the nose 170 terminal locking studs 172 which are constantly spaced from one another about the body 162 by an angular distance corresponding to that between the cavities 8a. Each stud 172 has a terminal locking edge portion 174 best seen in FIG. 18. There extends from each stud 172 towards the end 166 of the body 162, a guide rib 176 which is of smaller width circumferentially of the body 162, than the stud 172 and which terminates radially outwardly, in a rounded nose 178. Each rib 176 has concave sides 177, the smooth curvature of which is complementary with that of the side walls 157 of the wells 156. The body 162 is formed with four circumferentially aligned, latching ribs 180, each positioned between the ribs 176 of an adjacent pair and being spaced from the studs 172 towards the trailing end 166 of the retainer 142.

Figure 18:
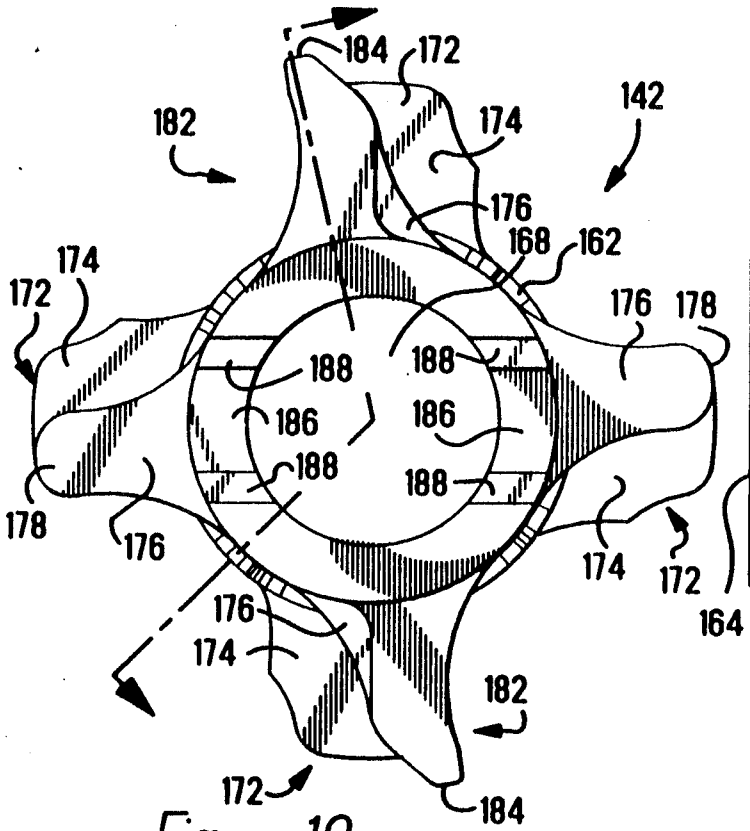
FIG. 18 is a rear end view of the terminal retainer shown in FIG. 17.
Figure 22:
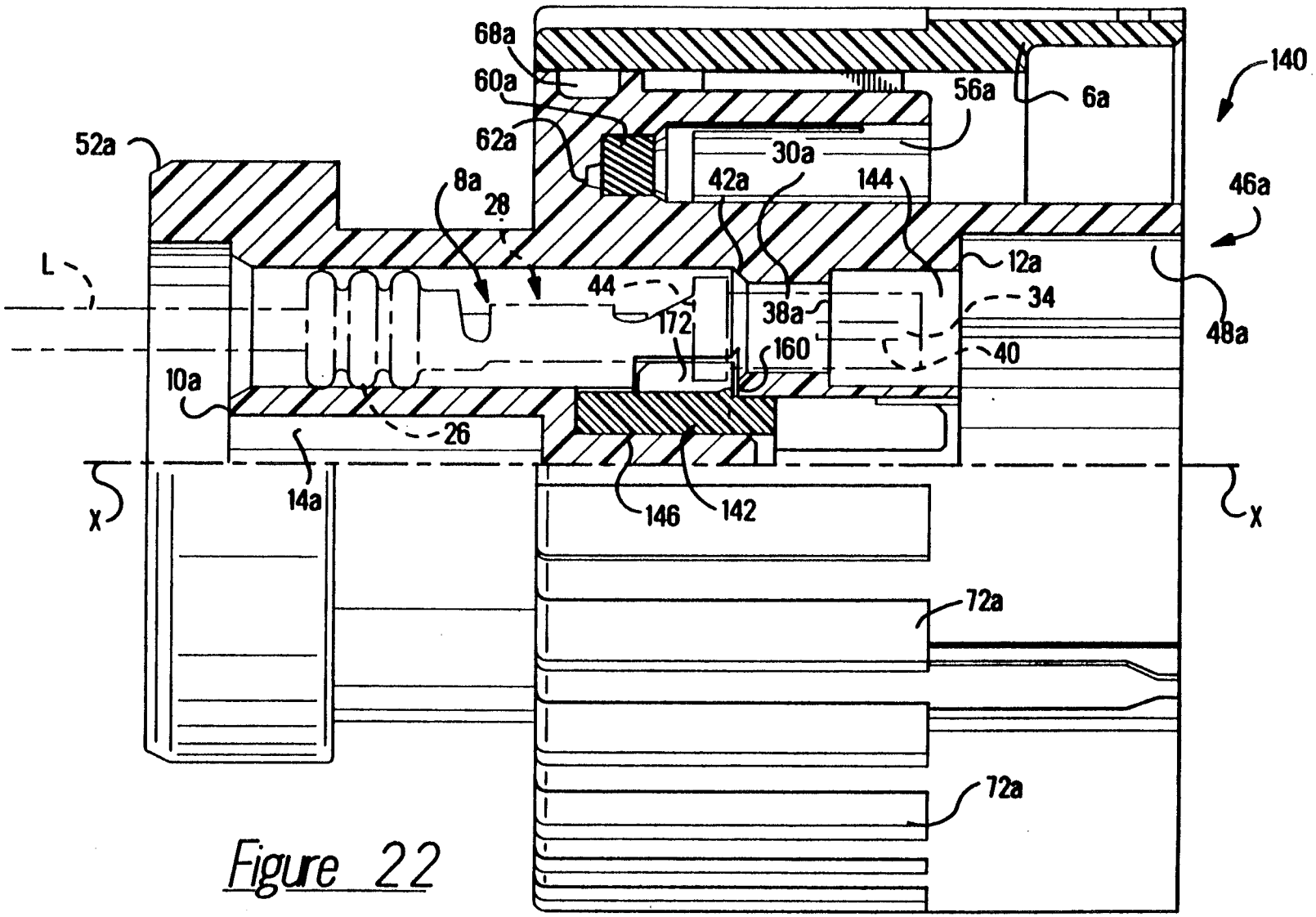
FIG. 22 is a side view shown partly in longitudinal section of the housing shown in FIG. 21 but with the terminal retainer in a terminal locking angular position therein and an electrical terminal shown in broken lines.
Figure 23:
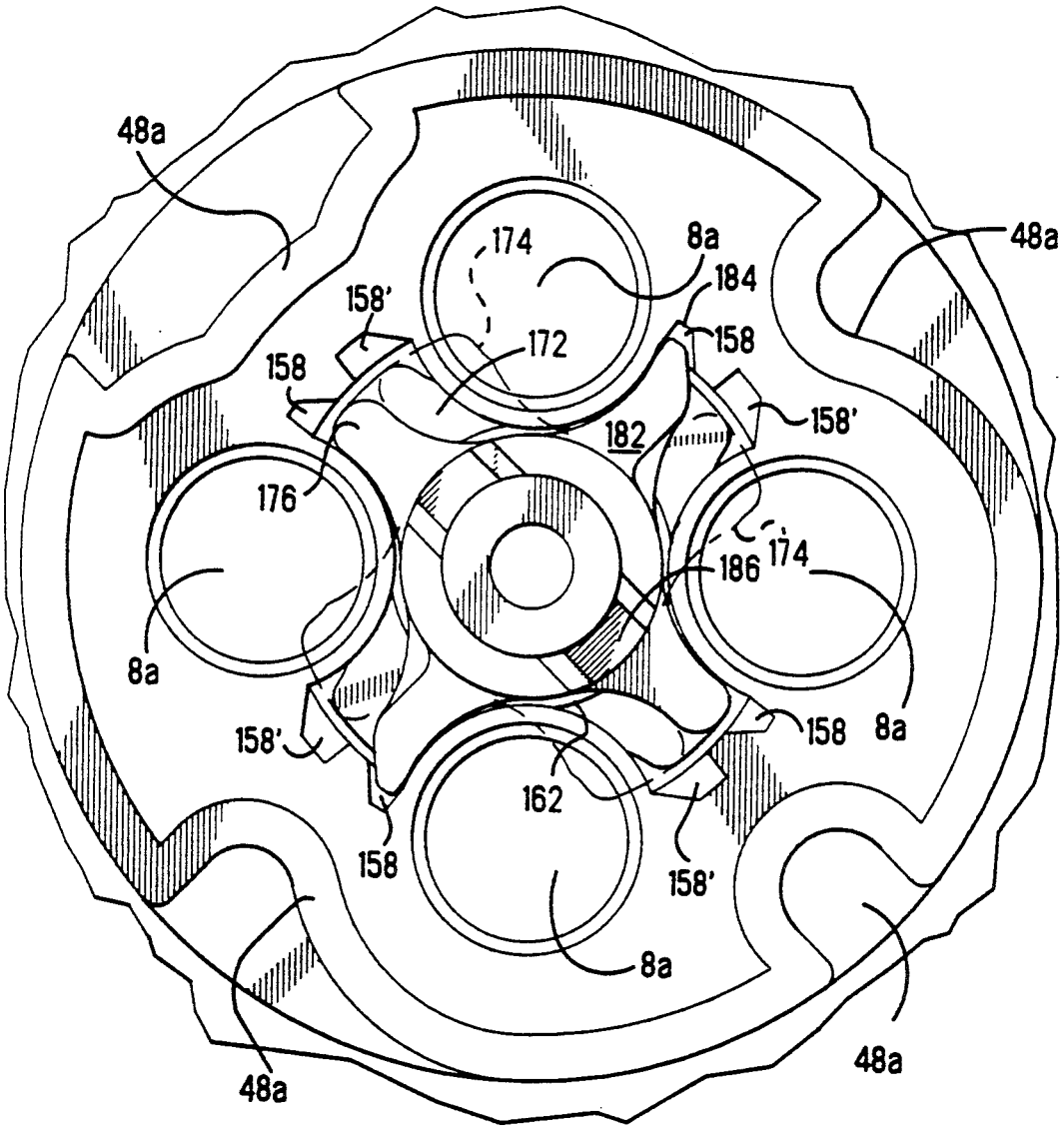
FIG. 23 is an enlarged fragmentary front view showing details of FIG. 21.

The body 162 is further formed, with a pair of diametrically opposed latching spurs 182 spaced from the ribs 176 in a direction away from the leading end 164 and each having a radially outwardly tapered latching tip 184, the tips 184 being oppositely inclined circumferentially of the retainer 142, as best seen in FIGS. 18 and 23. There open into the trailing 166 a pair of aligned slots 186 with chamfered guide edges 188 to receive a tool blade (not shown), for angularly displacing the retainer 142 between terminal receiving, and terminal latching angular positions when it has been assembled to the housing 140 as described below. In order to do this, the terminal retainer 142, with its end 164 leading, is mated with the spigot 146, so as to be received in the recess 152 until the ribs 180 snap into latching engagement behind respective shoulders 21a in the cavities 8a, and the nose 170 is received in the length 159 of the recess 152. The studs 172 are then each disposed in a respective well 156 as will be apparent from FIG. 23. The side 177 of the ribs 176, which, during the mating of the retainer 142 with the spigot 146 engage the side walls 157 of the wells 156 serve to guide the latching tip 184 of each spur 182 into a respective notch 158, these notches being diametrically opposite to one another. Terminal retainer 142 is then in its terminal insertion angular position, since the edge portions 174 of the studs 172 lie between the cavities 8a and so do not obstruct them. Terminals 28 are then inserted into the cavities 8a so that the latching tongues 34 of the terminals latch behind the shoulders 38a in those cavities. In order to shift the terminal retainer 142 from its terminal receiving position to its terminal locking position, the said tool blade is inserted into the slots 186 of the retainer 142, which are accessible from the mating face 12a, and the tool is employed to rotate the retainer 142 through a few degrees about the spigot 146, to displace the latching tips 184 of the spurs 182 each from its notch 158 into the adjacent notch 158', whereby the retainer 142 is latched in its terminal locking angular position in which the locking edge portions 174 of the studs 172 lie just behind the flanges 144 of the terminals 28 so as to prevent their withdrawal from the cavities 8a, as shown in FIG. 22, in which the spigot 146 and the terminal retainer 142 are shown as being cut back to reveal a pair of the notches 158 and 158'.

Figure 21:
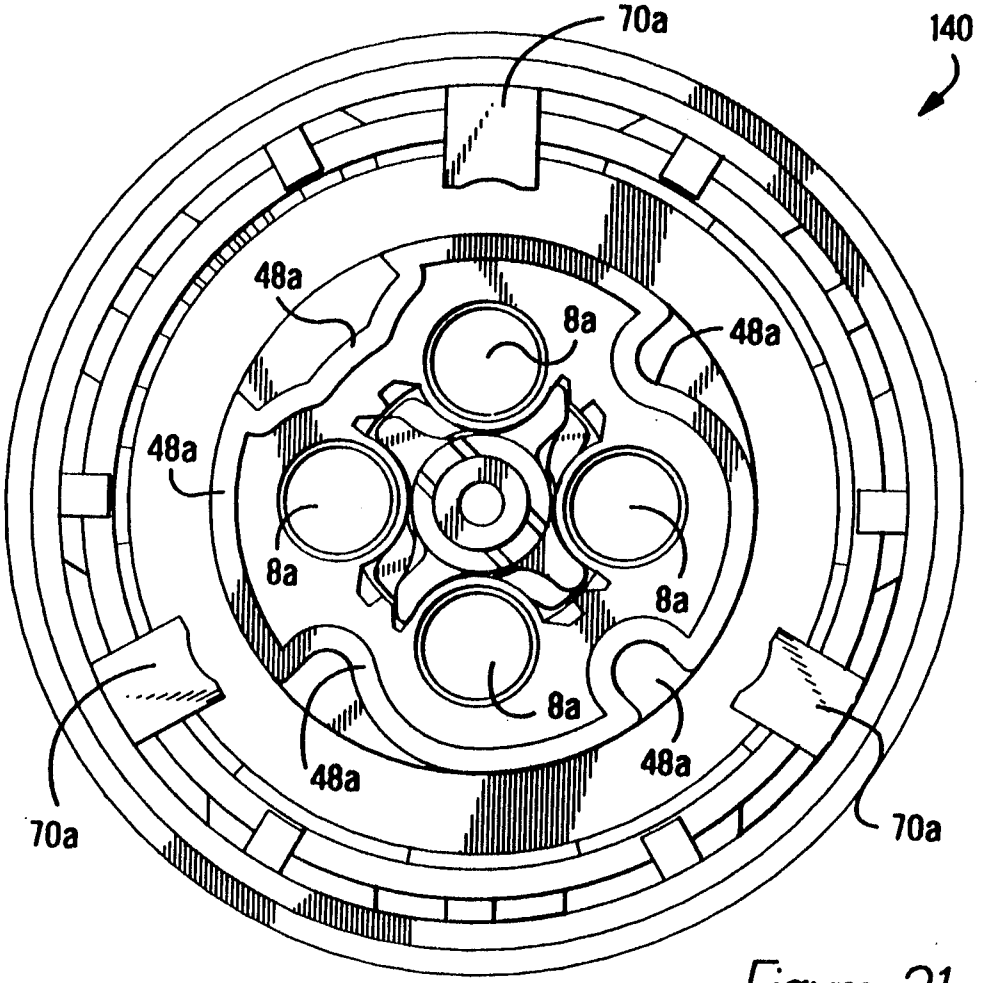
FIG. 21 is a front end view of the housing of FIGS. 13 to 16 with the terminal retainer thereof assembled thereto and in a terminal insertion angular position.
Figure 20:
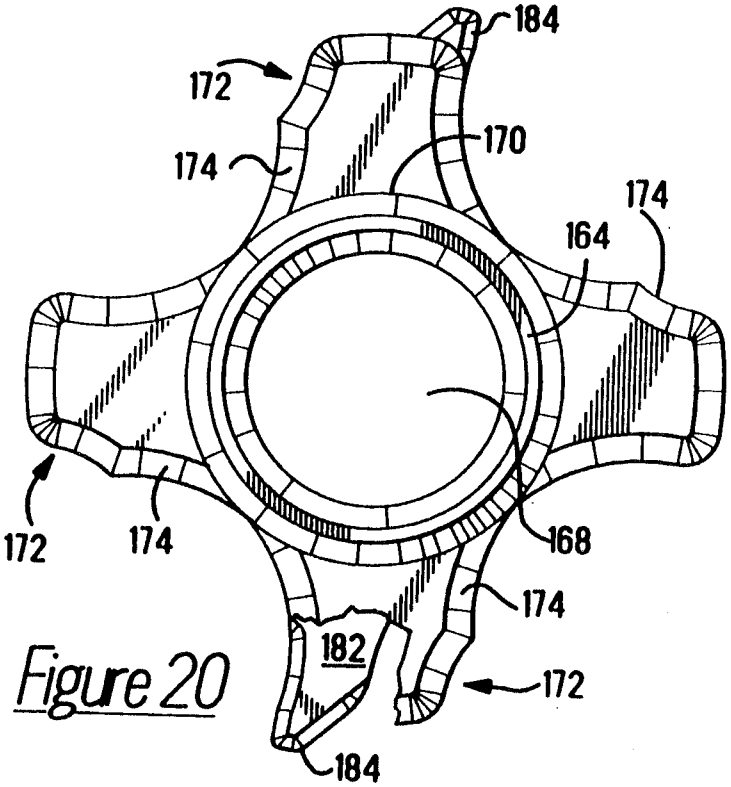
FIG. 20 is a front end view of the terminal retainer of FIGS. 17 to 19.

It will be apparent from FIGS. 14, 21 and 23 that four pairs of latching notches 158 and 158' are provided although the terminal retainer 142 has only one pair of matching spurs 182, thus enabling the terminal retainer 142 to be mated with the spigot 146 in two different angular orientations spaced from one another by 45°. Be it noted that each rib 176 has two opposite sides 177 which are of the same configuration.

We claim:

1. An electrical connector insulating housing defining a series of spaced, elongate, terminal receiving cavities surrounding an axis of the housing and extending lengthwise of said axis, the housing receiving a terminal retainer for angular displacement about said axis between a first angular position to allow electrical terminals to be inserted into the cavities and a second angular position to overlie abutments on the terminals when they have been inserted into the cavities, to lock the terminals therein, the cavities are arranged in a single ring about said axis and the terminal retainer, which is annular, is mounted for said angular displacement on a spigot which projects as a cantilever within said ring of cavities from a housing wall which extends transversely of the cavities, the spigot positioned proximate the axis of the housing, the terminal retainer has radially outwardly directed terminal retaining members which intersect the cavities in the second annular position of the terminal retainer to overlie the abutments of the terminals the terminal retainer is insertable into an annular recess defined by the housing between the spigot and radially inner walls of the cavities, with the aid of guide means provided on the terminal retainer and cooperating with complementary guide means on the spigot or between the cavities, to locate the terminal retainer in its first angular position, the terminal retainer having a latching means cooperating with shoulders presented by said inner walls to latch the terminal retainer in said recess.

2. A housing according to claim 1 wherein the spigot has at least one latch arm formed with first and second external, circumferentially spaced, latching notches, the terminal retainer having at least one inwardly directed latching spur for latching engagement with the first notch in the first position of the terminal retainer and in the second notch in the second position of the terminal retainer.

3. A housing according to claim 1 wherein the spigot comprises an annular wall concentric with said axis and which extends from said housing wall towards a mating face of the housing, a solid part extending from said annular wall and towards the mating face and a longitudinally divided part extending from said solid part up to said mating face and defining a pair of opposite latch arms, each formed with first and second external, circumferentially spaced, latching notches, the annular wall and said solid part being formed with a longitudinally indented keying surface, the terminal retainer comprising a pair of internally projecting latching spurs each for latchingly engaging in a respective first notch in the first annular position of the terminal retainer and in a respective second notch in the second angular position of the terminal retainer, and a resilient key for engaging in slots of said longitudinally divided part, and in said keying surface.

4. A housing according to claim 1 wherein the spigot is tubular and is of constant circular cross section, the terminal retainer having a constant circular cross section bore for receiving the spigot.

5. A housing according to claim 4 wherein the terminal retaining members are positioned proximate to a leading end of the terminal retainer, there extending from each terminal retaining member towards an opposite, trailing end of the terminal retainer and radially outwardly thereof, a guide rib which is of substantially equal height to, but of substantially smaller circumferential width, than the terminal retaining member, for cooperation with guide surfaces in wells defined by the housing between the cavities thereof and opening into a mating face of the housing.

6. A housing according to claim 1 wherein the cantilever spigot is formed with a longitudinally indented keying surface proximate to said transverse wall and extending in the direction of the free end of the spigot, the terminal retainer having an radially inwardly projecting resilient keying pad, shaped complementary with said keying surface, and which is aligned therewith in the first angular position of the terminal retainer.

7. A housing according to claim 6 wherein said keying pad which extends longitudinally of the terminal retainer is formed with an internal opening substantially throughout its length, a wall of the keying pad having an external surface facing inwardly of the terminal retainer and being formed with a pair of spaced longitudinal ribs each for engaging in a trough of said keying surface.

8. An electrical connector insulating housing defining a series of spaced, elongate, terminal receiving cavities surrounding an axis of the housing and extending lengthwise of said axis, the housing receiving a terminal retainer for angular displacement about said axis between a first angular position to allow electrical terminals to be inserted into the cavities and a second angular position to overlie abutments on the terminals when they have been inserted into the cavities, to lock the terminals therein, the cavities are arranged in a single ring about said axis and the terminal retainer, which is annular, is mounted for said angular displacement on a spigot which projects as a cantilever within said ring of cavities from a housing wall which extends transversely of the cavities, the spigot positioned proximate the axis of the housing, the terminal retainer has radially outwardly directed terminal retaining members which intersect the cavities in the second angular position of the terminal retainer to overlie the abutments of the terminals, the terminal retainer has a pair of diametrically opposed, radially outwardly projecting, latching spurs, the housing being formed between the cavities thereof with circumferentially spaced latching notches for receiving a latching tip of one of the latching spurs in the first and second angular positions, respectively, of the terminal retainer.

9. An electrical connector insulating housing defining a series of spaced, elongate, terminal receiving cavities surrounding an axis of the housing and extending lengthwise of said axis, the housing receiving a terminal retainer for angular displacement about said axis between a first angular position to allow electrical terminals to be inserted into the cavities and a second angular position to overlie abutments on the terminals when they have been inserted into the cavities, to lock the terminals therein, the cavities are arranged in a single ring about said axis and the terminal retainer, which is annular, is mounted for said angular displacement on a spigot which projects as a cantilever within said ring of cavities from a housing wall which extends transversely of the cavities, the spigot positioned proximate the axis of the housing, the terminal retainer has radially outwardly directed terminal retaining members which intersect the cavities in the second angular position of the terminal retainer to overlie the abutments of the terminals, the housing defines between each pair of adjacent cavities, a well opening into a mating face of the housing, for receiving a respective terminal retaining member of the terminal retainer, each well communicating, proximate to a mating face of the housing with first and second latching notches extending radially outwardly from the well, each for receiving in the first and second angular positions, respectively, of the terminal retainer, a latching tip of a latching spur projecting radially outwardly from the terminal retainer.

10. A housing according to claim 9 wherein each well communicates in the circumferential direction of the housing with a respective cavity thereof and has side walls for cooperating with complementary guide surfaces on longitudinal guide ribs on the terminal retainer to guide it into the housing in its first angular position.

* * * * *